US006461130B1

(12) United States Patent
Sun et al.

(10) Patent No.: US 6,461,130 B1
(45) **Date of Patent: *Oct. 8, 2002**

(54) SCROLL COMPRESSOR WITH UNIQUE MOUNTING OF NON-ORBITING SCROLL

(75) Inventors: Zili Sun; Greg Hahn, both of Arkadelphia, AR (US)

(73) Assignee: Scroll Technologies, Arkadelphia, AR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/657,752

(22) Filed: Sep. 8, 2000

(51) Int. Cl.[7] ..... F04C 18/04
(52) U.S. Cl. ..... 418/55.5; 418/57; 418/55.4
(58) Field of Search ..... 418/55.4, 55.5, 418/57

(56) References Cited

U.S. PATENT DOCUMENTS

| | | | | | |
|---|---|---|---|---|---|
| 4,365,941 | A | * | 12/1982 | Tojo et al. | 418/55.5 |
| 4,708,607 | A | * | 11/1987 | Hayano et al. | 418/55.5 |
| 4,877,382 | A | * | 10/1989 | Caillat et al. | 418/55.5 |
| 5,277,563 | A | * | 1/1994 | Wen-Jen et al. | 418/55.5 |
| 5,613,841 | A | * | 3/1997 | Bass et al. | 418/57 |

FOREIGN PATENT DOCUMENTS

| | | | | |
|---|---|---|---|---|
| JP | 59-117895 | | 8/1984 | |
| JP | 4-5490 | * | 1/1992 | 418/55.5 |
| JP | 6-173864 | * | 6/1994 | 418/57 |

* cited by examiner

*Primary Examiner*—John J. Vrablik
(74) *Attorney, Agent, or Firm*—Carlson, Gaskey & Olds

(57) ABSTRACT

A scroll compressor has a non-orbiting scroll axially secured within an end cap. The compressor is of the sort wherein the back pressure chamber is defined behind the orbiting scroll. In one embodiment a spring biases the non-orbiting scroll toward the orbiting scroll. In other embodiments the non-orbiting scroll is force fit within the end cap.

4 Claims, 3 Drawing Sheets

SCROLL COMPRESSOR WITH UNIQUE MOUNTING OF NON-ORBITING SCROLL

BACKGROUND OF THE INVENTION

This invention relates to a unique way of mounting the non-orbiting scroll such that it is not pinched.

Scroll compressors have been becoming widely utilized in refrigerant compression applications. In the scroll compressor, a pair of scroll members each have a base and a generally spiral wrap extending from the base. The wraps interfit to define compression chambers. One of the two scroll members is caused to orbit relative to the other, and as the two orbit the size of the compression chambers is reduced. An entrapped refrigerant is compressed and discharged through a discharge port.

During this compression, a force is created from the entrapped refrigerant tending to force the two scroll members away from each other. If the two scroll members move away from each other, then the compression chambers are no longer sealed, and adequate compression may not occur. Thus, it is typical to provide a force behind one of the two scroll members biasing that one scroll member towards the other. The other scroll member is typically axially fixed. In one type of scroll compressor, the back pressure chamber which creates the resisting force is placed behind the orbiting scroll. In such a scroll compressor the non-orbiting scroll is typically axially fixed. Typically, a housing member is crimped onto the non-orbiting scroll to lock it against movement. Some problems are created with this construction in that the crimping force may cause deformation in the non-orbiting scroll, and further puts design requirements on the non-orbiting scroll.

Further, the non-orbiting scroll is often welded to the housing. The weld joint further creates the potential for damage, and further complicates the design considerations.

SUMMARY OF THE INVENTION

In disclosed embodiments of this invention, a non-orbiting scroll member is secured against axial movement without being crimped to any of the housing members. In this way, the challenges raised by the crimping force in the prior art are eliminated.

In one embodiment, the non-orbiting scroll has a seal at its outer periphery that seals on the inner periphery of an end cap. A spring biases a non-orbiting scroll back towards the orbiting scroll. The back pressure chamber is provided behind the orbiting scroll. At startup of the scroll compressor, there is little force behind the non-orbiting scroll holding it toward the orbiting scroll. However, the spring will hold the two scroll members in contact until compression begins, and the pressure behind the orbiting scroll builds up. At steady state operation the discharge pressure in a chamber behind the non orbiting scroll will hold it against the orbiting scroll.

One further advantage of this embodiment is that in the event the scroll members begin to rotate in a reverse direction, which is an undesirable event that does sometimes occur, a vacuum is created in the nominal discharge chamber, and overcomes the spring force and allow the two scroll members to move out of contact with each other. This will reduce or prevent damage to the scroll members and the remainder of the compressor.

In a second embodiment the non-orbiting scroll is force fit into an end cap. The force fit is designed to have sufficient force such that it can resist the separating force from the entrapped gas until the discharge pressure can build up. In a further modification of this basic embodiment, a tube is placed between the rear of the non-orbiting scroll and the end cap to further secure the non-orbiting scroll in place within the end cap. The two balance to provide a muffler function.

These and other features of the present invention can be best understood from the following specification and drawings, the following of which is a brief description.

DETAILED DESCRIPTION OF A PREFERRED EMBODIMENT

Figure 1:
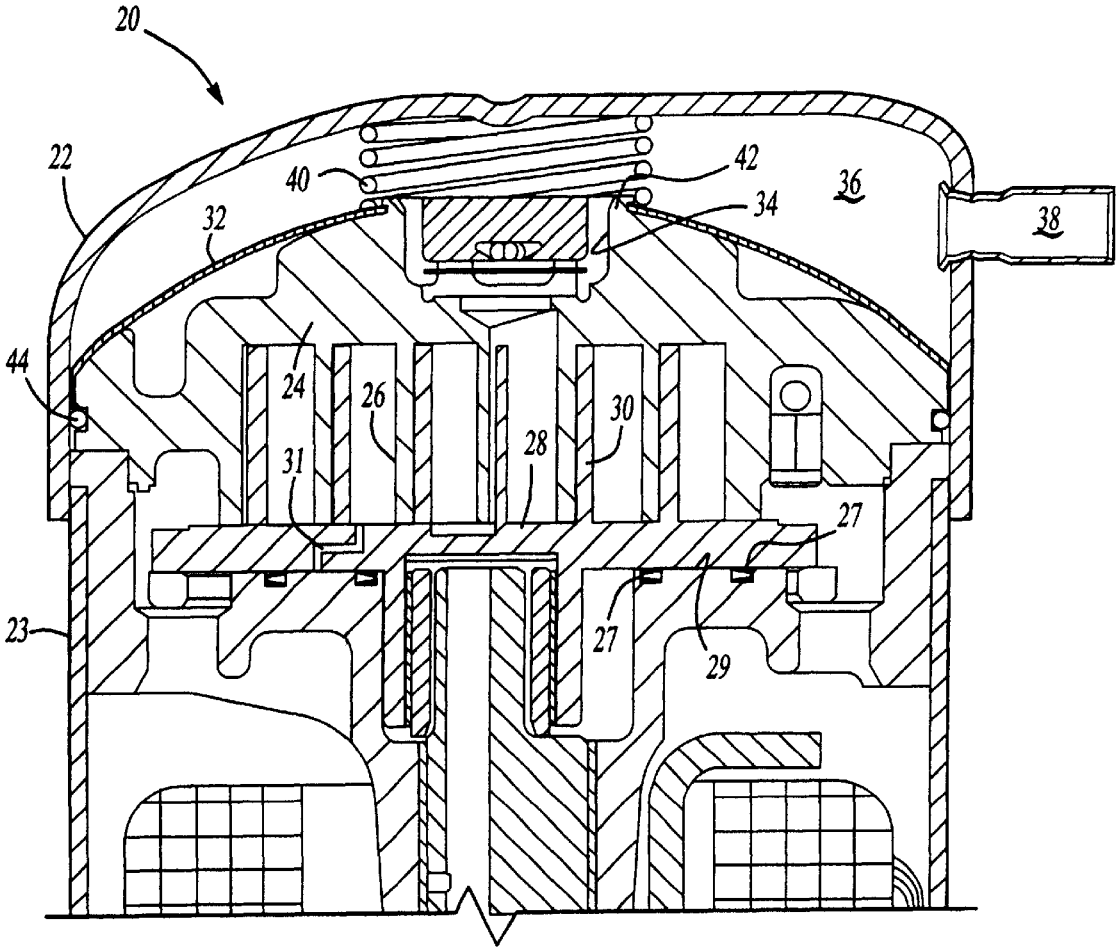
FIG. 1 shows a first embodiment.

A scroll compressor 20 is illustrated in FIG. 1 having an end cap 22 secured to a center shell housing 23. A non-orbiting scroll 24 has a wrap 26 intermeshed with an orbiting scroll 28 and its wrap 30. A heat shield 32 is included in this embodiment, however, the present invention extends to scroll compressors having this particular feature. Generally, this invention is directed to scroll compressors wherein a back pressure chamber 29, defined by seals 27, is defined behind the orbiting scroll, and yet the non-orbiting scroll is not secured by a weld or crimp connection to the end cap 22. As shown, a tap 31 taps refrigerant to chamber 29.

As is known, a refrigerant is trapped between the wraps 26 and 30, and discharged through a discharge port 34, and into a discharge chamber 36. As shown in this embodiment, the non-orbiting scroll is spaced from the end cap 22 to define the discharge chamber 36. In the prior art, there has typically been a separator plate between the two. This invention is particularly advantageous in scroll compressors wherein there is no separator plate.

From the chamber 36 the refrigerant is discharged through the discharge tube 38.

In this embodiment, a spring 40 sits on a boss 42 on the non-orbiting scroll 24. The spring 40 engages end cap 22 and urges the non-orbiting scroll 24 toward the orbiting scroll 28. A seal 44 on the outer periphery on the non-orbiting scroll 24 seals between the inner periphery of the end cap 22 and the outer periphery of the non-orbiting scroll 24.

At startup, the pressure in the discharge chamber 36 will be low. As the refrigerant is compressed the separating force between the scroll members 24 and 28 will increase. However, the spring 40 will continue to urge the non-orbiting scroll 24 toward the orbiting scroll 28 and the two will be held together. A further beneficial feature of this embodiment is that the scroll members 24 and 28 will be allowed to move away from each other in the event of reverse rotation occurring for any length of time. Reverse rotation occurs such as when a motor for driving the orbiting scroll 28 is improperly wired and the orbiting scroll 28 rotates in a reverse direction from that which is desired. In such a case, refrigerant is moved in the opposed direction and enters through the discharge port 34. This would then cause a vacuum in the chamber 36. This vacuum will overcome the spring force 40 and cause the non-orbiting scroll 24 to move away from the orbiting scroll 28. At any rate, the above embodiment overcomes several deficiencies in the prior art as described above.

Figure 2:
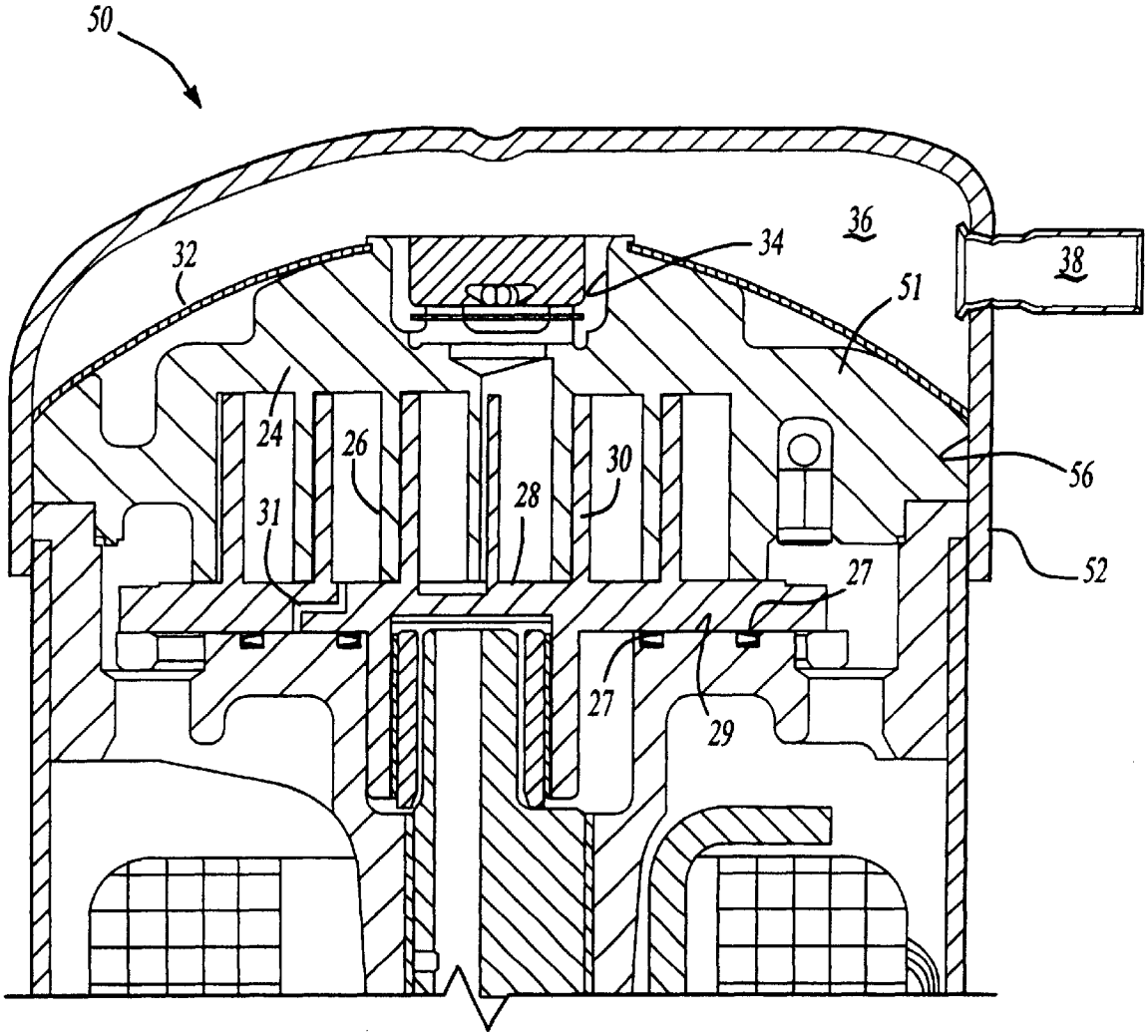
FIG. 2 shows a second embodiment.

FIG. 2 shows another embodiment 50 wherein the end cap 52 receives the nonorbiting scroll 51 in a force fit connection. The inner periphery 56 of the end cap 52 receives the non-orbiting scroll in this force fit. The force fit is sufficient such that at startup the force fit will resist movement of the non-orbiting scroll 51 until the pressure in the chamber 36 can build up to sufficient pressures.

Figure 3:
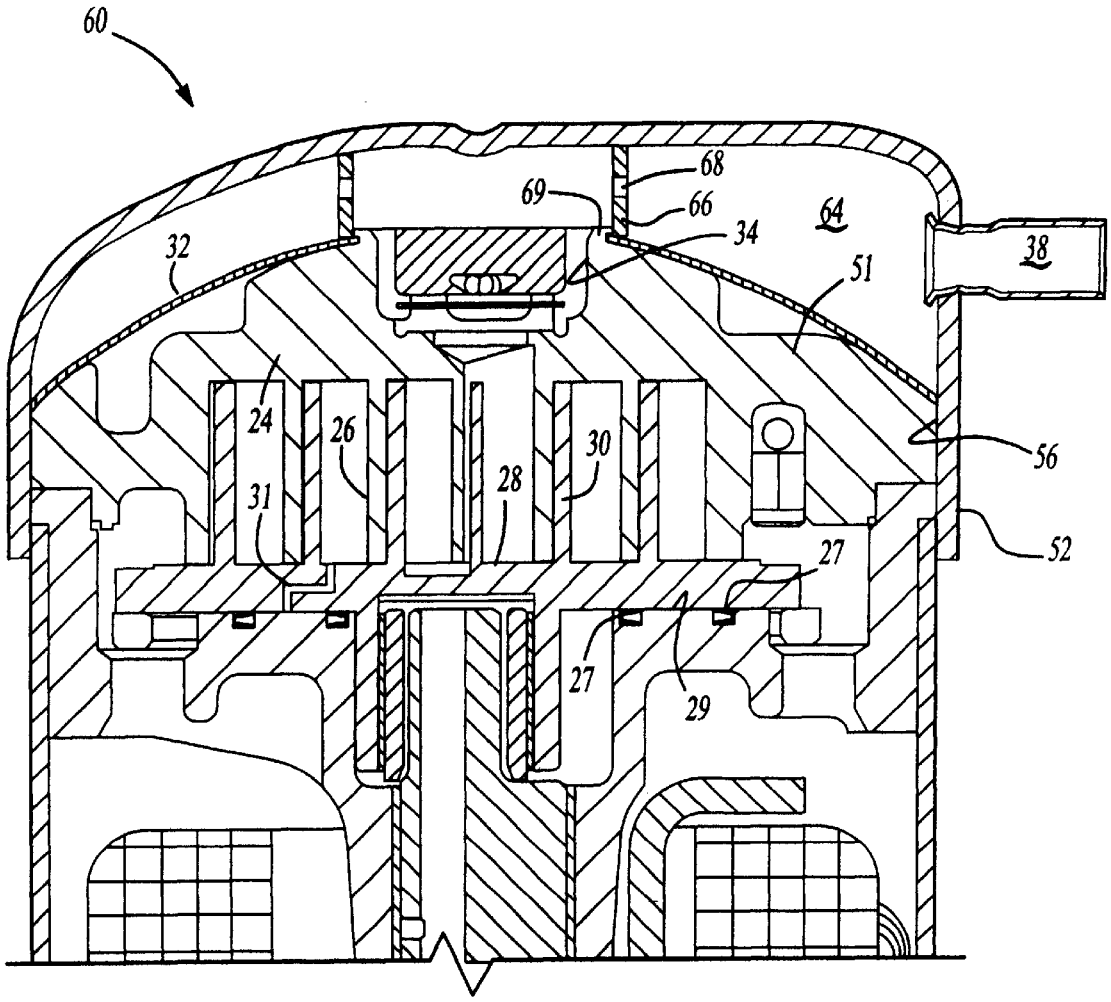
FIG. 3 shows a third embodiment.

FIG. 3 shows yet another embodiment 60 wherein the discharge chamber 64 communicates with the port 34 through an opening 68 in a tube 66. Tube 66 is mounted on a boss 69 similar to the boss 42 in FIG. 1. The tube 66 holds the non-orbiting scroll 51 against the orbiting scroll without the use of the weld joint or crimped connection. Further, the tube and its ports 68 provide a discharge muffler function.

The above embodiments could be generally described as having a non-orbiting scroll of the type wherein the back pressure chamber is defined behind the orbiting scroll, and yet the non-orbiting scroll in the end cap is not welded or held by any crimped connection. Although several embodiments have been disclosed, a worker in this art would recognize that many modifications would come within the scope of this invention. For that reason, the following claims should be studied to determine the true scope and content of this invention.

What is claimed is:

1. A scroll compressor comprising:

a non-orbiting scroll having a base and a generally spiral wrap extending from said base;

an orbiting scroll having a base and a generally spiral wrap extending from said base, said wraps interfitting to define compression chambers;

a housing including an end cap enclosing said orbiting and said non-orbiting scroll, said housing defining a discharge pressure chamber on one side of said nonorbiting scroll and a suction pressure chamber being defined on an opposed side of said non-orbiting scroll;

a back pressure chamber behind said base of said orbiting scroll;

said non-orbiting scroll being urged towards said orbiting scroll by a spring providing a force between said end cap and said non-orbiting scroll; and a discharge port to communicate a compressed refrigerant from said compression chamber to said discharge chamber, said discharge chamber providing a pressure force holding said non-orbiting scroll by urging said non-orbiting scroll toward said orbiting scroll, and a suction port on said opposed side of said non-orbiting scroll and supplying a suction pressure refrigerant into said suction chamber.

2. A scroll compressor as recited in claim 1, wherein said non-orbiting scroll provides a separation seal between said suction and discharge pressure chambers.

3. A scroll compressor as recited in claim 1 wherein a seal is placed between an outer periphery of said base of said non-orbiting scroll and an inner periphery of said end cap.

4. A scroll compressor comprising:

a non-orbiting scroll having a base and a generally spiral wrap extending from said base;

an orbiting scroll having a base and a generally spiral wrap extending from said base;

a housing including an end cap enclosing said orbiting and said non-orbiting scroll, said housing defining a discharge pressure chamber on one side of said non-orbiting scroll and a suction pressure chamber being defined on an opposed side of said non-orbiting scroll;

a back pressure chamber behind said base of said orbiting scroll;

said non-orbiting scroll being urged towards said orbiting scroll by a spring providing a force between said end cap and said non-orbiting scroll;

a discharge port to communicate a compressed refrigerant from said compression chamber to said discharge chamber providing a pressure force holding said non-orbiting scroll by urging said non-orbiting scroll toward said orbiting scroll, and a suction port on said opposed side of said non-orbiting scroll and supplying a suction pressure refrigerant into said suction chamber; and a seal placed between outer periphery of said base of said non-orbiting scroll and the inner periphery of said end cap.

* * * * *